US010041189B2

(12) United States Patent
Kocis et al.

(10) Patent No.: US 10,041,189 B2
(45) Date of Patent: Aug. 7, 2018

(54) METHOD FOR PRODUCTION OF POLYMERIC NANOFIBERS BY SPINNING OF SOLUTION OR MELT OF POLYMER IN ELECTRIC FIELD

(71) Applicants: TECHNICKA UNIVERZITA V LIBERCI, Liberec (CZ); EGU—HV LABORATORY a.s., Prague (CZ)

(72) Inventors: Lubomir Kocis, Ostra (CZ); Pavel Pokorny, Frydlant v Cechach (CZ); David Lukas, Liberec (CZ); Petr Mikes, Mnisek u Liberce (CZ); Jiri Chvojka, Liberec (CZ); Eva Kostakova, Turnov (CZ); Jaroslav Beran, Liberec (CZ); Martin Bilek, Liberec (CZ); Jan Valtera, Dvur Kralove nad Labern (CZ); Evzen Amler, Prague (CZ); Matej Buzgo, Turna nad Bodvou (SK); Andrea Mickova, Bratislava (SK)

(73) Assignees: TECHNICKA UNIVERZITA V LIBERCI (CZ); EGU—HV LABORATORY A.S. (CZ)

( * ) Notice: Subject to any disclaimer, the term of this patent is extended or adjusted under 35 U.S.C. 154(b) by 352 days.

(21) Appl. No.: 14/650,436

(22) PCT Filed: Dec. 12, 2013

(86) PCT No.: PCT/CZ2013/000166
§ 371 (c)(1),
(2) Date: Jun. 8, 2015

(87) PCT Pub. No.: WO2014/094694
PCT Pub. Date: Jun. 26, 2014

(65) Prior Publication Data
US 2015/0315724 A1 Nov. 5, 2015

(30) Foreign Application Priority Data
Dec. 17, 2012 (CZ) ..... 2012-907

(51) Int. Cl.
*D01D 5/00* (2006.01)
*D04H 1/728* (2012.01)

(52) U.S. Cl.
CPC ..... *D01D 5/0069* (2013.01); *D01D 5/003* (2013.01); *D01D 5/0023* (2013.01);
(Continued)

(58) Field of Classification Search
CPC .. D01D 5/0007; D01D 5/0015; D01D 5/0023; D01D 5/003; D01D 5/0038;
(Continued)

(56) References Cited

U.S. PATENT DOCUMENTS 2,048,651 A * 7/1936 Norton ..... D01D 5/0092 264/10 X
2003/0226750 A1 12/2003 Fenn ..... 204/164
(Continued)

FOREIGN PATENT DOCUMENTS

WO WO 2009/049564 A2 4/2009

OTHER PUBLICATIONS

Maheshwari, Siddarth et al. "Assembly of Multi-Stranded Nanofiber Threads through Ac Electrospinning." Advanced Materials 21 (2009): 349-54.*
(Continued)

*Primary Examiner* — Leo B Tentoni
(74) *Attorney, Agent, or Firm* — Ostrolenk Faber LLP

(57) ABSTRACT

The invention relates to a method for production of polymeric nanofibers, in which polymeric nanofibers are created due to the action of force of an electric field on solution or melt of a polymer, which is located on the surface of a
(Continued)

spinning electrode, whereby the electric field for electrostatic spinning is created alternately between the spinning electrode (1), to which is supplied alternating voltage, and ions (30, 31) of air and/or gas generated and/or supplied to proximity of the spinning electrode (1), whereby according to the phase of the alternating voltage on the spinning electrode (1) polymeric nanofibers with an electric charge of opposite polarity and/or with segments with an electric charge of opposite polarity are created, which after their creation cluster together under the influence of the electrostatic forces into linear formation in the form of a tow or a band, which moves freely in space in direction of gradient of the electric fields away from the spinning electrode (1). The invention further relates to a linear formation from polymeric nanofibers fabricated by this method.

4 Claims, 5 Drawing Sheets

(52) U.S. Cl.
CPC ..... *D01D 5/0038* (2013.01); *D01D 5/0046* (2013.01); *D01D 5/0092* (2013.01); *D04H 1/728* (2013.01); *D01D 5/0076* (2013.01); *D10B 2321/06* (2013.01); *Y10T 442/60* (2015.04)

(58) Field of Classification Search
CPC .. D01D 5/0046; D01D 5/0069; D01D 5/0076; D01D 5/0092
USPC ..... 264/10, 464, 465, 466, 484
See application file for complete search history.

(56) References Cited

U.S. PATENT DOCUMENTS

2004/0217010 A1* 11/2004 Hu ..... D01D 5/0015 205/341
2005/0117864 A1* 6/2005 Dziekan ..... G02B 6/02347 385/125
2008/0265469 A1 10/2008 Li et al. ..... 264/433
2009/0189319 A1 7/2009 Kim ..... 264/484
2011/0171239 A1* 7/2011 Kaplan ..... A61L 27/227 424/172.1
2011/0278751 A1* 11/2011 Ishikawa ..... D01D 5/0069 264/10
2012/0013047 A1* 1/2012 Ishikawa ..... D01D 5/0069 264/465

OTHER PUBLICATIONS

International Search Report dated Mar. 3, 2014 in corresponding PCT International Application No. PCT/CZ2013/000166.
Written Opinion dated Mar. 3, 2014 in corresponding PCT International Application No. PCT/CZ2013/000166.
R. Kessick et al., "The use of AC potentials in electrospraying and electrospinning processes," Polymer 45:2981-2984 (2004).
S. Maheshwari et al., "Assembly of Multi-Stranded Nanofiber Threads through AC Electrospinning," Advanced Materials 21:349-354 (2009).
S. Sarkar et al., "Biased AC Electrospinning of Aligned Polymer Nanofibers," Macromolecular Rapid Communications 28:1034-1039 (2007).

* cited by examiner

METHOD FOR PRODUCTION OF POLYMERIC NANOFIBERS BY SPINNING OF SOLUTION OR MELT OF POLYMER IN ELECTRIC FIELD

CROSS-REFERENCE TO RELATED APPLICATIONS

The present application is a 35 U.S.C. § § 371 national phase conversion of PCT/CZ2013/000166, filed Dec. 12, 2013, which claims priority to Czech Republic Patent Application No. PV 2012-907, filed Dec. 17, 2012, the contents of which are incorporated herein by reference. The PCT International Application was published in the English language.

TECHNICAL FIELD

The invention relates to a method of production of polymeric nanofibers, in which polymeric nanofibers are created by an action of force of an electric field on solution or melt of a polymer on surface of a spinning electrode.

The invention further relates to a linear formation from polymeric nanofibers fabricated by this method.

BACKGROUND ART

Typical product of all to date known methods for spinning of solutions or melts of polymers in an electric field using static needle spinning electrodes (nozzles, capillaries, etc.) or needleless spinning electrodes (rotating cylinder, cord moving in a direction of its length, rotating coil, coated cord, etc.) is planar layer of randomly interlaced nanofibers of the same polarity. Such a layer has in combination with other supporting or covering layers number of applications, namely in the field of filtration and hygienic means, but on the other hand, for number of other applications, as well as for further processing by standard textile technological methods is its usage rather limited. That is because these applications prefer linear formations from nanofibers, or more complex three-dimensional structures created by processing of such linear formations.

In this sense, for example US 2008265469 describes a method of production of linear formation from nanofibers which is based on the principle of direct drawing off of nanofibers from several pairs of against each other arranged nozzles having electric charges of opposite polarity, and subsequent connection of these nanofibers. This only leads to low production output, which is moreover not constant, due to mutual influence of the electric fields of individual nozzles. Thus the resulting linear formation has considerably non-uniform and accidental structure as well as low tensile strength, thanks to which this method is suitable only for experimental use in laboratory.

US 20090189319 describes a method for fabrication of linear formation from nanofibers by twisting a planar layer of nanofibers formed by electrostatic spinning. Linear formation created in this manner, has also only limited tensile strength and is not suitable for practical use. In addition, the method of twisting the planar layer of nanofibers is technologically relatively complicated and time-consuming, achieving only low productivity, and so this method is applicable only in limited laboratory scale.

Another possibility for fabrication of linear formation from nanofibers is by using collecting electrode according to WO 2009049564, which in one of the described embodiments comprises a system of singular electric charges arranged on an abscissa or on the circumference of rotating disc. Created nanofibers are hereat deposited preferably along these electric charges, thus forming linear formations. Tensile strength of formations fabricated in this manner may be higher than that of the formations fabricated according to any of the preceding methods, but still insufficient for practical applications. Another drawback of this method is relatively small length of fabricated linear formation from nanofibers achievable, as it is limited by the maximum possible length of the collecting electrode. For this reason, this method, too, cannot be successfully used in industrial scale.

The goal of the invention is to eliminate or at least to reduce the disadvantages of the background art and to propose a method for production of nanofibers, which would enable fabrication of linear formation from polymeric nanofibers which could be further utilized or processed by standard textile technological procedures, the method maintaining sufficient productivity and applicability in an industrial production.

PRINCIPLE OF THE INVENTION

The goal of the invention is achieved by a method of production of polymeric nanofibers through spinning solution or melt of a polymer in an electric field, in which polymeric nanofibers are created by action of force of the electric field on the solution or melt of polymer, which is located on surface of a spinning electrode. Its principle consists in that the electric field for electrostatic spinning is formed alternately between the spinning electrode connected to a source of alternating voltage and ions of air and/or gas created and/or supplied to its proximity, whereby according to the phase of the alternating voltage on the spinning electrode polymeric nanofibers with an electric charge of opposite polarity and/or with segments with an electric charge of opposite polarity are created which cluster together after their creation due to the effect of electrostatic forces, creating thus linear formation in the form of a tow or a band, which moves freely in space in direction of gradient of the electric field in a direction from the spinning electrode. Linear formation fabricated in this manner from polymeric nanofibers has different macroscopic and microscopic structure and therefore also different mechanical properties than similar materials produced by electrostatic spinning by means of direct voltage, and can be processed by standard textile technological procedures. Linear formation being fabricated then moves in space above the spinning electrode, whereby, if it is necessary or desirable, it can be captured on stationary or moving collector. If it is captured on planar stationary or moving collector, it forms a layer of nanofibers, or, in other words, deposits into a layer of nanofibers.

Suitable parameters of alternating voltage which ensure continuous and long-term spinning are voltage in the range from 12 to 36 kV and frequency ranging from 35 to 400 Hz.

The goal of the invention is further achieved by linear formation from polymeric nanofibers fabricated by this method, whose principle consists in that it is electrically neutral and is formed by polymeric nanofibers arranged in an irregular grid structure, in which individual nanofibers in segments of length in the order of micrometers change their direction. Due to this structure the formation acquires better mechanical properties than linear formations created according to methods that are known so far, whereby it can be further processed by standard textile technological procedures, such as twisting, and a thread or a yarn may be fabricated from it.

DESCRIPTION OF DRAWINGS

In the enclosed drawings there is on the

EXAMPLES OF EMBODIMENT

Figure 1:
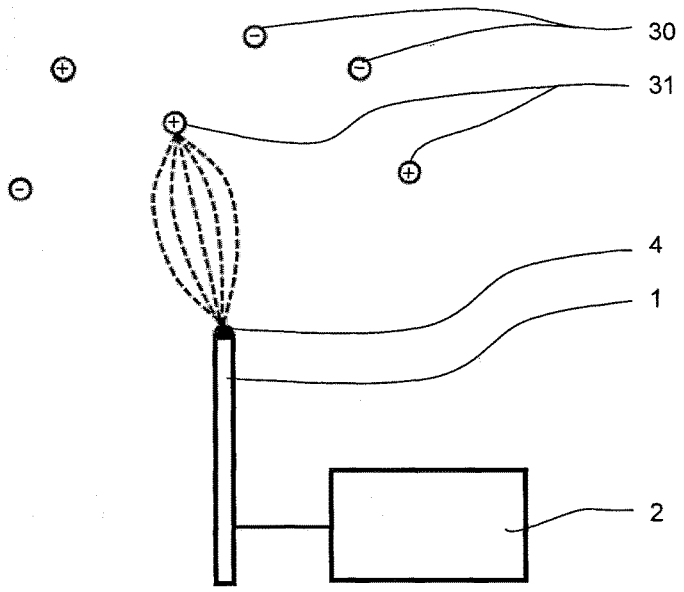
FIG. 1 schematically shown one embodiment of a device for performing the method for production of polymeric nanofibers through spinning of solution or melt of a polymer in an electric field according to the invention, and the principle of this method, on the FIG. 2 a photo of Taylor cones created on the layer of solution of a polymer, on the FIG. 3 a photo of linear formation from nanofibers from polyvinyl butyral fabricated by the method according to the invention, on the FIG. 4 an SEM image of this formation at 24× magnification, on the FIG. 5 an SEM image of this formation at 100× magnification, on the FIG. 6 an SEM image of this formation at 500× magnification, on the FIG. 7 an SEM image of different part of this formation at 500× magnification, on the FIG. 8 an SEM image of this formation at 1010× magnification, and on the FIG. 9 an SEM image of this formation at 7220× magnification with measured diameters of individual fibers.

The method for production of polymeric nanofibers according to the invention is based on spinning of solution or melt of a polymer, which is located on surface of a spinning electrode or is continuously or intermittently supplied onto it, while the spinning process runs due to the alternating voltage supplied to the spinning electrode. In the embodiment of a device for performing this method shown at FIG. 1 there is the spinning electrode 1 formed by static rod connected to a source 2 of alternating voltage, however, in other not shown embodiments it is possible for performing the method according to the invention use any other known type or shape of the spinning electrode 1—such as a static spinning electrode 1 formed by a nozzle, needle, rod, lamella, etc. or by their array, or by moving surface spinning electrode 1 composed of rotating cylinder, rotating coil, rotating disc or another rotating body, or a cord moving in a direction of its length, etc. Generally any static or moving body, which is at least locally convex in the area of the placement or supply of the solution or melt of a polymer, can be in principle used as the spinning electrode 1.

Figure 2:
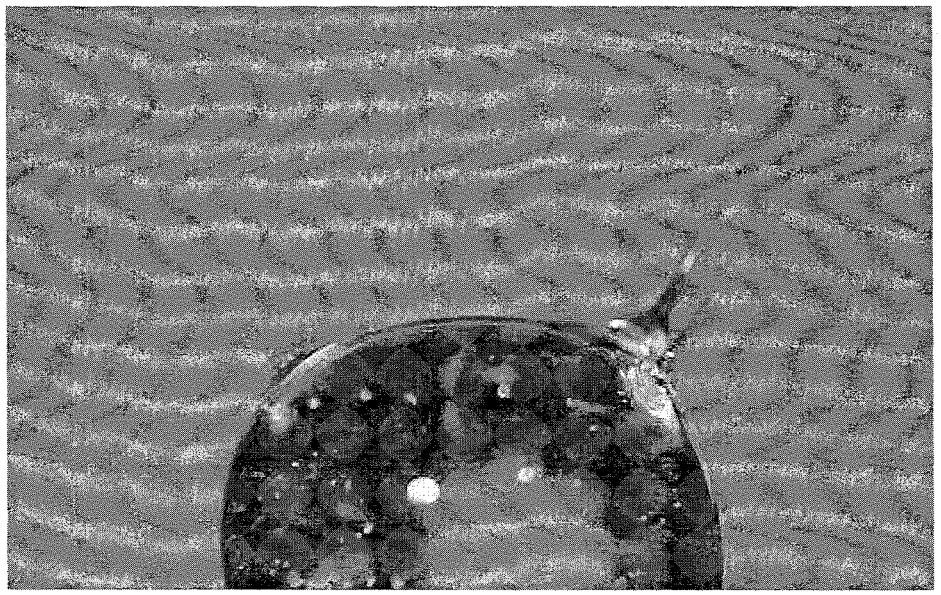
Figure 3:
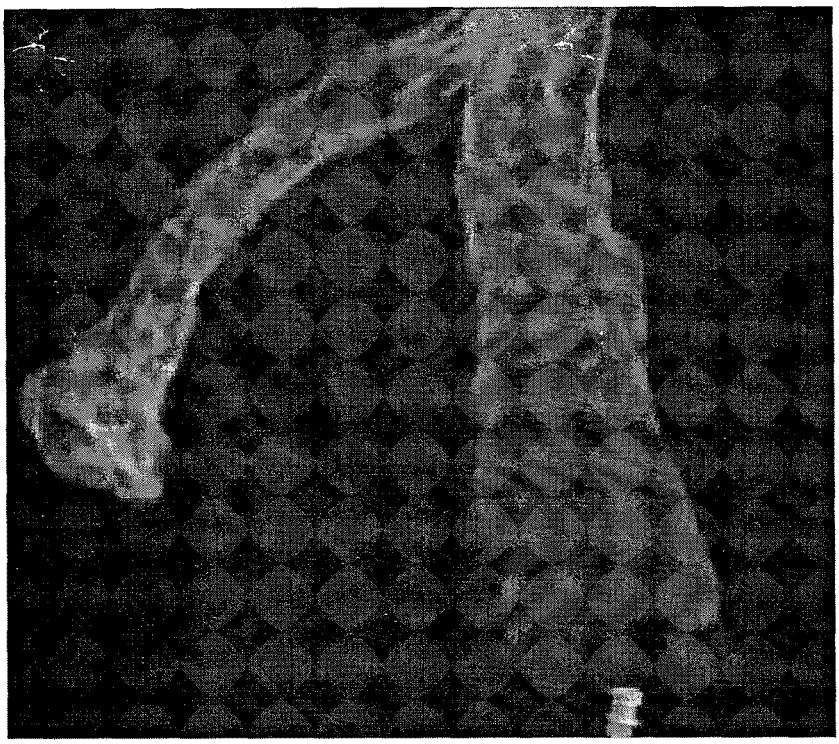
Figure 4:
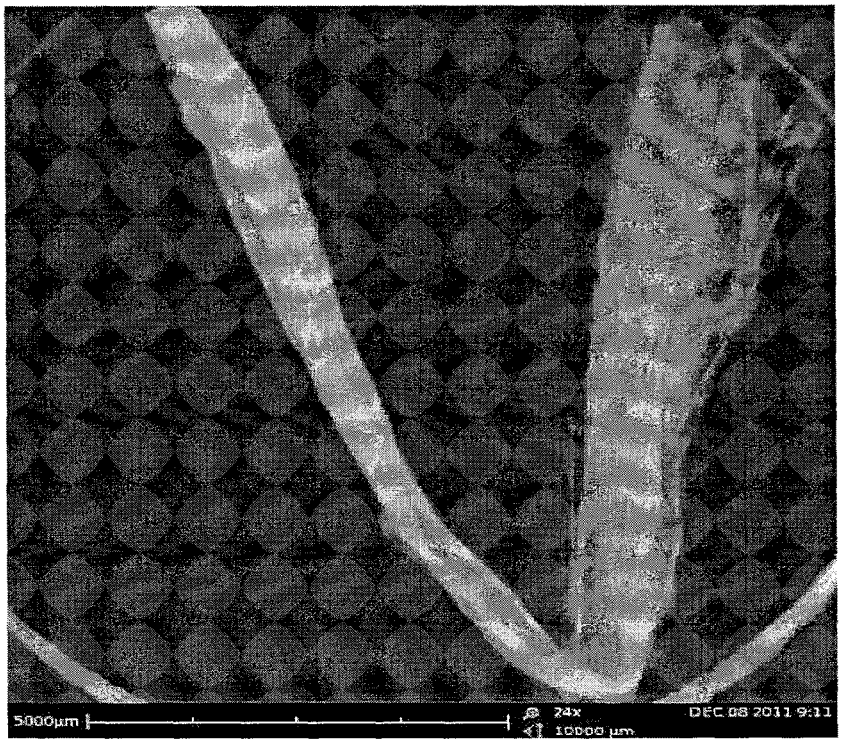
Figure 5:
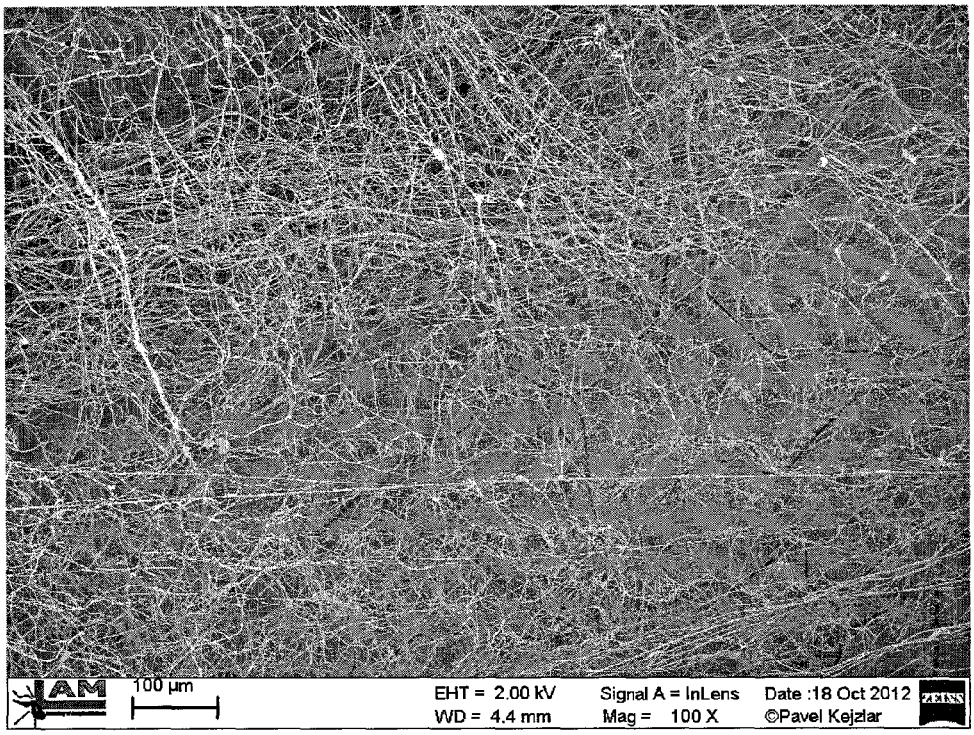
Figure 6:
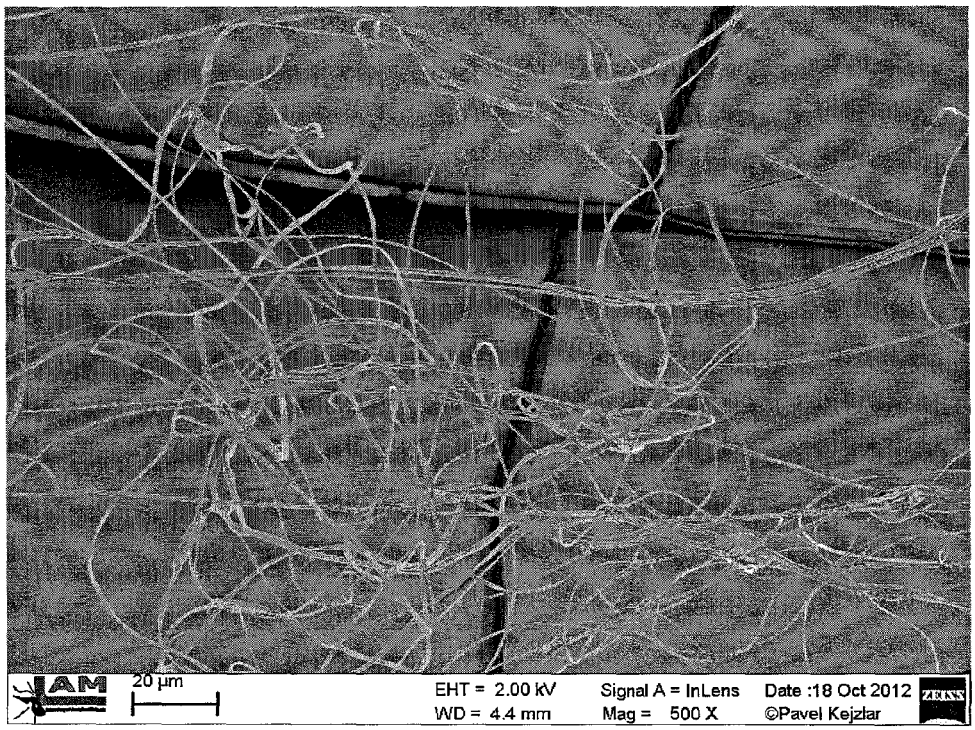
Figure 7:
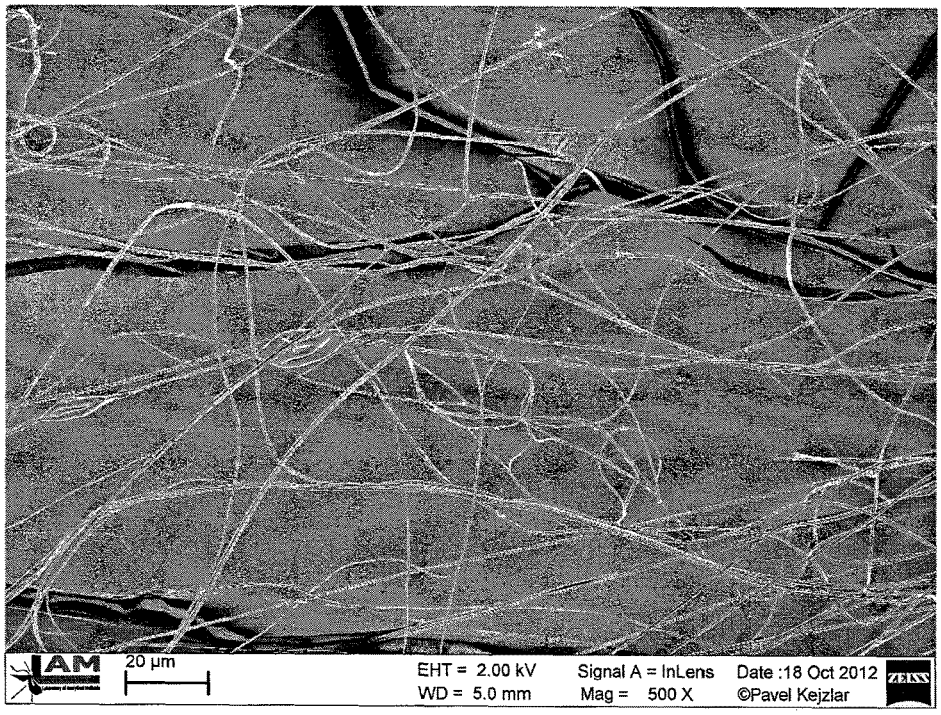
Figure 8:
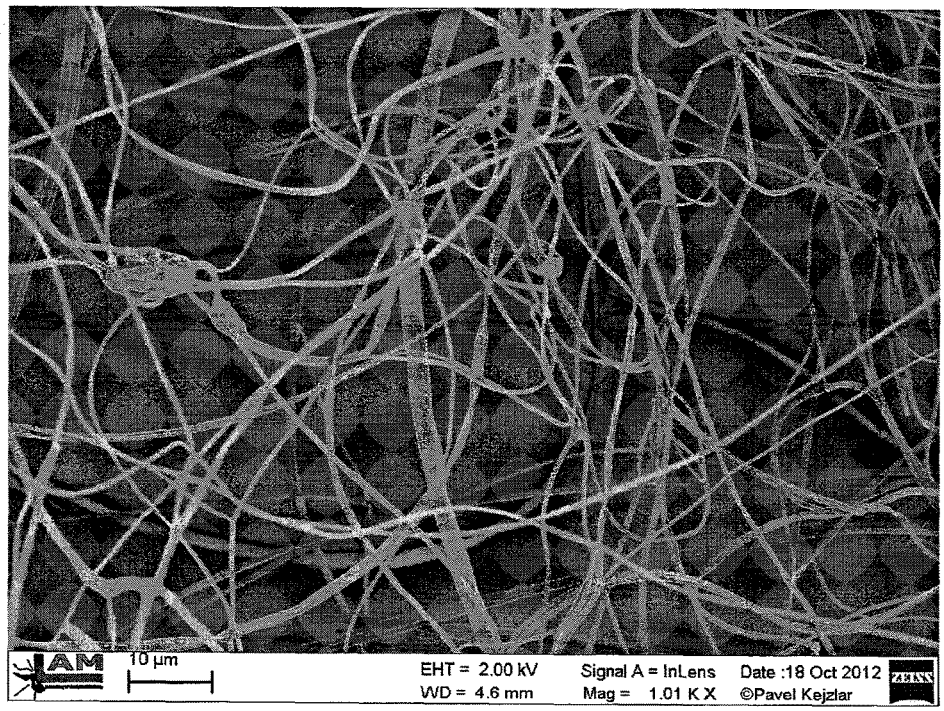
Figure 9:
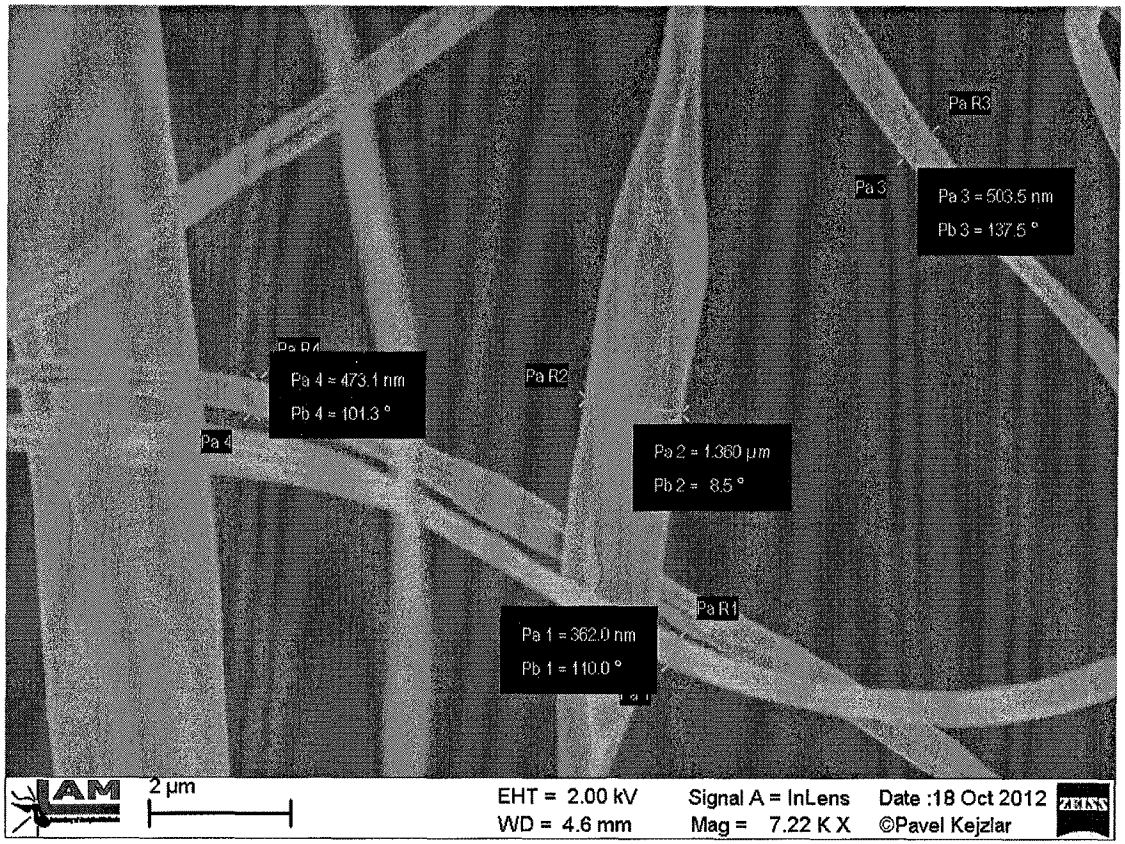

After supplying alternating voltage onto the spinning electrode 1 according to the current phase and polarity of this voltage the electric field for spinning is created between this spinning electrode 1 and ions 30 or 31 of the ambient air or some other gas which has been supplied and/or is continuously supplied to its proximity of the opposite polarity. These ions 30 or 31 are either generated in the proximity of the spinning electrode 1 or are attracted to its proximity by the action of the voltage that is supplied onto it. In an not shown embodiment it is then possible to place and/or to direct suitable source of positive and/or negative ions 30 or 31 to the proximity of the spinning electrode 1, the source being in operation at least before and/or during the start of spinning. Due to the action of forces of these electric fields on the surface of the layer 4 of solution or melt of polymer located on surface of the spinning electrode electrode 1 are formed so-called Taylor cones (see FIG. 2), from which subsequently individual polymeric nanofibers are enlongated. At the same time, alternating voltage on the spinning electrode 1, resp. periodical change of polarity of the spinning electrode 1 does not allow the system air (gas)-solution or melt of polymer being spun, which is in contact with the spinning electrode 1, to achieve constant balance in the distribution of ions 30, 31 of air (gas), and so in essence the spinning process can continue for any arbitrary period of time, for example until depletion of predetermined amount of solution or melt of polymer. Surprisingly, it was proved during the experiments, that if the frequency of alternating voltage was sufficiently high (the minimum of approximately 35 Hz), the Taylor cones did not disappear during the change of the polarity of alternating voltage.

The polymeric nanofibers created according to this method shape up into a linear three-dimensional formation, which immediately after leaving the spinning electrode 1 fulfills the definition of an aerogel, i.e. a porous ultralight material (produced so far by removing the liquid component from a gel or polymeric solution). Due to regular change of phase and polarity of the alternating voltage on the spinning electrode 1 individual nanofibers, or even different segments of individual nanofibers, carry different electric charges, and, consequently, almost instantly after being created they cluster together by the influence of electrostatic forces, forming compact linear formation in the form of a tow or a band. Furthermore, as a result of alternately repeated polarity of electric charges polymeric nanofibers regularly change their direction in segments with length in order of micrometers (as can be seen in FIGS. 3 to 8), forming an irregular grid structure of mutually densely interlaced nanofibers with repeating points of contact between them. Due to this structure, which is fundamentally different from similar formations fabricated by electrostatic spinning by means of direct voltage, this formation also acquires substantially better mechanical properties.

After its creation, the linear formation from polymeric nanofibers fabricated according to this method moves in a direction of the gradient of the electric fields being created perpendicularly or almost perpendicularly away from the spinning electrode 1. The linear formation itself is electrically neutral, since during its movement in space, mutual recombination of opposite electric charges of individual nanofibers or its segments occurs. Therefore it is possible to capture it mechanically on stationary or moving collector, which, in essence, does not need to be electrically active (i.e. no electric voltage needs to be supplied onto it), nor does it need to be created from electrically conducting material. The linear formation captured is at the same time due to relatively large attractive forces between individual nanofibers (electrostatic forces between dipoles, intermolecular forces, or in some cases also adhesive forces) capable of further processing by standard textile technological procedures, and can be for example twisted and a thread or a yarn, etc. may be prepared from it, or it can be processed by another method.

When the linear formation from nanofibers is captured on planar stationary or moving collector, such as for example a plate, a grid, a belt, etc., this linear formation is deposited on the surface of the collector in form of planar layer of polymeric nanofibers. Such a layer as well as autonomous linear formation from polymeric nanofibers can be for example used as cell culture substrate for tissue engineering, since their morphology is more similar to natural structures of intercellular matter than morphology of structures which have been used so far. In addition, they can be utilized in other technical applications using nanofibrous—microfibrous materials, such as for filtration applications, etc.

During series of verification tests was onto the spinning electrode 1 formed of electrically conducting rod having a diameter of 1 cm supplied an alternating voltage in the range from 12 to 36 kV, with frequency ranging from 35 to 400 Hz. In this manner, without using a collecting electrode, exemplary solutions of polyvinyl butyral (PVB), polycaprolactone (PCL) a polyvinyl alcohol (PVA) were spun. It was observed that with growing frequency of alternating voltage the efficiency of spinning decreased and finer nanofibers were created.

Example 1

By means of spinning electrode 1 formed of electrically conducting rod having diameter of 1 cm, a solution of 10% of weight of polyvinyl butyral (PVB) in mixed solvent containing water and alcohol in the volume ratio 9:1 was subject to spinning. This solution was supplied continuously to the spinning electrode 1 by means of linear pump in the rate of 50 ml/hr. Alternating effective voltage supplied to the spinning electrode 1 was set to 25 kV with the frequency of 50 Hz. Achieved output of spinning was 5 g of dried weight of nanofibers/hr. On FIGS. 3 to 9 there are images of the linear formation prepared in this manner with various magnifications, whereby it is apparent that the produced nanofibers have diameter smaller than 1 μm, and from FIGS. 5 to 8 also the grid structure of fabricated linear formation with visible change of the direction of the nanofibers.

Example 2

In the same manner as in Example 1 an aqueous solution of polyvinyl alcohol (PVA) was spun. The solution was applied discontinuously with a brush on horizontally arranged spinning electrode 1 formed of a wire having a diameter of 2 mm and length of 200 mm. Effective alternating voltage supplied to the spinning electrode 1 was set to 30 kV with the frequency of 300 Hz. The output achieved under these conditions was approximately 4 g of dry weight of nanofibers/hr.

The invention claimed is:

1. A method for production of polymeric nanofibers, in which polymeric nanofibers are created due to the action of force of an electric field on a solution or melt of a polymer, which is located on the surface of a spinning electrode, wherein the electric field for electrostatic spinning is created alternately between the spinning electrode, onto which is supplied alternating voltage, and ions of air and/or gas generated and/or supplied to the proximity of the spinning electrode, with no opposing electrode arranged with the spinning electrode, whereby according to the phase of the alternating voltage on the spinning electrode polymeric nanofibers with an electric charge of opposite polarity and/or with segments with an electric charge of opposite polarity are created, which after their creation cluster together under the influence of the electrostatic forces into a linear formation in the form of a tow or a band, which moves freely in space in direction of gradient of the electric fields, away from the spinning electrode.

2. The method according to claim 1, wherein the linear formation from polymeric nanofibers is captured on stationary or moving collector.

3. The method according to claim 1, wherein the linear formation from polymeric nanofibers is captured on planar stationary or moving collector, on which it is deposited into planar layer of polymeric nanofibers.

4. A method according to claim 1, wherein onto the spinning electrode is supplied alternating voltage in the range from 12 to 36 kV, with frequency ranging from 35 to 400 Hz.

* * * * *